United States Patent [19]

Paton et al.

[11] 4,299,626

[45] Nov. 10, 1981

[54] TITANIUM BASE ALLOY FOR SUPERPLASTIC FORMING

[75] Inventors: Neil E. Paton, Thousand Oaks, Calif.; James A. Hall, Boulder City, Nev.

[73] Assignee: Rockwell International Corporation, El Segundo, Calif.

[21] Appl. No.: 185,086

[22] Filed: Sep. 8, 1980

[51] Int. Cl.[3] ..... C22C 14/00

[52] U.S. Cl. ..... 75/175.5

[58] Field of Search ..... 75/175.5

[56] References Cited

U.S. PATENT DOCUMENTS

| | | | |
|---|---|---|---|
| 2,892,706 | 6/1959 | Jaffee et al. | 75/175.5 |
| 2,906,654 | 9/1959 | Abkowitz | 75/175.5 |

FOREIGN PATENT DOCUMENTS

| | | | |
|---|---|---|---|
| 653682 | 12/1962 | Canada | 75/175.5 |
| 48-7971 | 3/1973 | Japan | 75/175.5 |

OTHER PUBLICATIONS

Khorev, "Complex Alloying of Titanium Alloys," Translated from Metallovedenie: Termicheskaya Obrabotka Metallov, No. 8, pp. 58–63, Aug. 1975.

*Primary Examiner*—Peter K. Skiff

*Attorney, Agent, or Firm*—H. Fredrick Hamann; Craig O. Malin

[57] ABSTRACT

A titanium base alloy with improved superplastic properties is provided. The alloy has 6% Al and from 1.5 to 2.5% of a beta-stabilizing element which has high diffusivity in titanium, namely Co, Fe, Cr, or Ni. In a preferred embodiment, the alloy is a Ti-6Al-4V type alloy modified by the addition of about 2% Fe.

2 Claims, No Drawings

TITANIUM BASE ALLOY FOR SUPERPLASTIC FORMING

BACKGROUND OF THE INVENTION

1. Field of the Invention

The invention relates to the field of metallurgy and particularly to the field of titanium base alloys.

2. Description of the Prior Art

In the development of titanium alloys, the main emphasis has been placed upon obtaining alloys which have good mechanical and physical properties (such as strength, toughness, ductility, density, corrosion resistance, etc.) for specific applications. In general the fabricators of finished parts have had to adapt their processing (machining, welding, forging, forming, etc.) to meet the requirements of the alloy.

One relatively new process which fabricators have used to form parts from titanium alloys is superplastic forming. As described in U.S. Pat. No. 4,181,000, the alloy is stressed at a strain rate and at a temperature which causes it to flow large amounts without necking down and rupturing. The ability of some alloys to flow under these conditions is a property called superplasticity. This property is measured using stress strain tests to determine the alloy's strain rate sensitivity, according to the classical equation:

$$\sigma = K\dot{\epsilon}^{m}$$

where:

m = strain rate sensitivity, $\sigma$ = stress, $\dot{\epsilon}$ = strain rate, and K = constant, The higher the value of m, the more superplastic the alloy being measured.

Fortunately, most titanium alloys exhibit superplastic properties under the proper conditions of stress and temperature. This fact is a fortunate happenstance because the alloys were formulated without any concern for, or even awareness of, the superplastic formability. As a result, prior art titanium alloys do not have optimum superplastic properties.

An example of such a prior art titanium alloy is an alloy designated as Ti-6Al-4V which is described in U.S. Pat. No. 2,906,654. This alloy is widely used because of its good properties and good fabricability. It is superplastic, having a maximum strain rate sensitivity ($^{m}$max) at 1600° F. in the range of 0.62 to 0.68.

SUMMARY OF THE INVENTION

It is an object of the invention to provide an improved titanium alloy.

It is an object of the invention to provide a titanium alloy having improved superplastic properties.

It is an object of the invention to provide a Ti-6Al-4V type alloy with improved superplastic properties.

It is an object of the invention to provide a Ti 6Al-4V type alloy with improved room temperature tensile strength.

According to the invention a titanium base alloy is provided with approximately 6% Al and from 1.5 to 2.5% of a beta stabilizing element which has a diffusivity in titanium at 1600° F. greater than $2.4\times10^{-10}$cm$^2$ sec. The beta stabilizing element lowers the beta transus, thus imparting superplasticity at lower temperatures. Because the beta stabilizing element has high diffusivity, it facilitates the material transfer required to deform the alloy, thus promoting superplasticity. At the same time, the beta stabilizing element raises the room temperature tensile strength.

In a preferred embodiment, the alloy includes from 0 to 4.5% V.

In another preferred embodiment, the beta stabilizing element is selected from the group consisting of Co, Fe, Cr, and Ni.

In another preferred embodiment, the alloy is a T-6Al-4V type alloy with from 1.5 to 2.5% Fe.

These and other objects and features of the present invention will be apparent from the following detailed description.

DESCRIPTION OF THE PREFERRED EMBODIMENT

In order to fabricate alloys by deformation, it is necessary to move material in the blank from its original position to another position dictated by the shape of the finished formed part. Under an applied forming stress, this movement is accomplished by mechanical movement of atoms according to various mechanisms such as diffusion flow and dislocation movement. Although atoms can move from one position to another by thermal diffusion, this mechanism is not important at low temperatures because the diffusion rate is low. Even at relatively high temperatures (such as forging temperature) where diffusion is more rapid, diffusion is not a major mechanism in conventional forming because it is slow compared to the imposed deformation rates.

In contrast to conventional forming operations, superplastic forming is accomplished over longer periods of time at relatively high temperatures, for example 15 to 60 minutes 1600° F. for Ti-6Al-4V alloy. This makes superplastic forming more expensive than conventional forming. However, superplastic forming can be used to form complex shapes which cannot be formed using conventional forming. To make superplastic forming more competitive with conventional forming, it is necessary to reduce the time and temperature required to form the part. In terms of the previously mentioned forming equation, $$\sigma = K\dot{\epsilon}^{m},$$

this means that the strain rate sensitivity, m, of the alloy must be increased.

In work leading to the present invention, it was discovered that the superplastic properties of the alloy can be improved by adding elements which have high rates of diffusion in titanium at the forming temperature. Conversely, the superplastic properties of the alloy decrease if elements having low diffusivity are added to the alloy. Apparently, thermal diffusion of these atoms under the gradient created by the forming stress assists in rearranging the material as required to conform it to the shape of the part being formed.

The diffusivities of several elements in titanium at 1600° F. are shown in Table I. These values are taken from the "Handbook of Chemistry and Physics" published by the Chemical Rubber Company. For the purpose of this invention, elements which have a diffusivity higher than the diffusivity of V ($2.4\times10^{-10}$) are considered to be high diffusivity elements because they would tend to increase the diffusivity of a Ti-6Al-4V alloy.

TABLE I

DIFFUSIVITY (D) OF BETA STABILIZING ELEMENTS AT 1600° F.

| Element | D, $cm^2$ sec | D of Element / D of V |
|---|---|---|
| Ni | $220 \times 10^{-10}$ | 92 |
| Co | $190 \times 10^{-10}$ | 79 |
| Fe | $78 \times 10^{-10}$ | 32 |
| Cr | $11 \times 10^{-10}$ | 4.6 |
| V | $2.4 \times 10^{-10}$ | 1.0 |
| Nb | $1.7 \times 10^{-10}$ | .7 |
| Mo | $0.6 \times 10^{-10}$ | .2 |
| W | $0.2 \times 10^{-10}$ | .09 |

Table II shows the effect of a high diffusivity element Fe and a low diffusivity element Mo on the superplastic properties of a Ti-6Al-4V alloy. The maximum strain rate sensitivity, $^{m}$max, of the prior art alloy is in the range of 0.62 to 0.68 at 1600° F. If 2% Fe is added to this alloy, $^{m}$max increases to 0.75 for a Ti-6Al-4V-2Fe composition and to 0.70 for a Ti-5Al-4V-2Fe composition. If the V is dropped from the alloy and replaced with 2% Fe (Ti-6Al-2Fe), $^{m}$max increases to 0.78. These results indicate that the addition of the high diffusivity element Fe increases $^{m}$max and therefore improves the superplastic properties of the alloy.

To determine if the converse is true, the V in a Ti-6Al-4V alloy was replaced with Mo. Mo has only 0.2 the diffusivity of V, in sharp contrast to Fe which has a diffusivity 32 times that of V. The maximum strain rate sensitivity of the Ti-6Al-2Mo alloy was only 0.60 indicating that the low diffusivity of the Mo reduced the superplastic properties of the alloy.

TABLE II

SUPERPLASTIC PROPERTIES AT 1600° F.

| Alloy | Max. Strain Rate Sensitivity $m_{max}$ | Strain Rate $\dot{\epsilon} = 2 \times 10^{-4} s^{-1}$: Strain Rate Sensitivity m | Strain Rate $\dot{\epsilon} = 2 \times 10^{-4} s^{-1}$: Stress (psi) $\sigma$ | Strain Rate $\dot{\epsilon} = 1 \times 10^{-3} s^{-1}$: Strain Rate Sensitivity m | Strain Rate $\dot{\epsilon} = 1 \times 10^{-3} s^{-1}$: Stress (psi) $\sigma$ |
|---|---|---|---|---|---|
| Ti-6Al-4V (prior art) | 0.62–0.68 | 0.52–0.62 | 1200–2300 | 0.40–0.54 | 3000–5600 |
| Ti-6Al-4V-2Fe | 0.75 | 0.70 | 1100 | 0.50 | 3000 |
| Ti-5Al-4V-2Fe | 0.70 | 0.60 | 900 | 0.45 | 2000 |
| Ti-6Al-2Fe | 0.78 | 0.66 | 2000 | 0.42 | 4800 |
| Ti-6Al-2Mo | 0.60 | 0.56 | 4000 | 0.40 | 9000 |

In addition to the requirement that the added element have high diffusivity, it should also tend to stabilize the beta form of Ti. Such elements lower the beta transus, thus imparting superplasticity at lower temperatures. Table I lists beta-stabilizing elements which have diffusivities greater than V and therefore are within the scope of this invention, namely Ni, Co, Fe, and Cr.

The room temperature tensile properties of three alloy compositions according to the invention are shown in Table III. The strengths of the Fe-containing compositions are somewhat higher than the strength of the prior art Ti-6A-4V alloy. However, the elongations of all the alloys are substantially the same. Thus, the improvement in superplasticity obtained by the invention has been accomplished without a reduction in room temperature tensile properties.

TABLE III

TENSILE PROPERTIES AT ROOM TEMPERATURE

| Alloy | Test Direction | Ultimate Tensile Strength, KSI | Yield Strength, KSI | Elongation, % Uniform | Elongation, % Total |
|---|---|---|---|---|---|
| Ti-6Al-4V | Long | 117.7 | 110.1 | 5.0 | 10.0 |
| (prior art) | Transv. | 129.4 | 123.6 | 5.0 | 11.5 |
| Ti-6Al- | Long | 148.0 | 138.8 | 5.0 | 11.0 |
| 4V-2Fe | Transv. | 167.2 | 158.0 | 10.0 | 13.0 |
| Ti-5Al- | Long | 139.2 | 132.1 | 3.8 | 9.5 |
| 4V-2Fe | Transv. | 155.4 | 148.2 | 7.5 | 11.0 |
| Ti-6Al- | Long | 123.3 | 112.2 | 7.5 | 13.5 |
| 2Fe | Transv. | 130.4 | 121.4 | 5.0 | 10.5 |

Numerous variations and modifications can be made without departing from the invention. Accordingly, it should be clearly understood that the form of the invention described above is illustrative, and is not intended to limit the scope of the invention.

What is claimed is:

1. A titanium base alloy for superplastic forming consisting essentially of about 4.5 to 6.5% Al, 1.5 to 2.5% Fe, 3.5 to 4.5% V, and balance titanium with minor additives and impurities.

2. An improvement in a titanium base alloy having about 6% Al and 4% V, said improvement comprising:

about 2% of a beta-stabilizing element selected from the group consisting of Co, Fe, Cr, and Ni, whereby said titanium alloy has improved superplastic forming properties.

* * * * *